US007380377B2

(12) United States Patent
Brinton et al.

(10) Patent No.: US 7,380,377 B2
(45) Date of Patent: Jun. 3, 2008

(54) ADJUSTABLE SKYLIGHT ANGLE ADAPTOR AND SYSTEM

(75) Inventors: James Eric Brinton, Greenwood, SC (US); Leonard Ken Moody, Jr., Greenwood, SC (US); Mark Albert Feucht, Greenwood, SC (US); Jeffrey Joseph Ronan, Greenwood, SC (US); Michael James Waters, Greenwood, SC (US)

(73) Assignee: VKR Holding A/S, Hoersholm (DK)

( * ) Notice: Subject to any disclaimer, the term of this patent is extended or adjusted under 35 U.S.C. 154(b) by 382 days.

(21) Appl. No.: 11/034,126

(22) Filed: Jan. 12, 2005

(65) Prior Publication Data

US 2006/0150542 A1 Jul. 13, 2006

(51) Int. Cl.
*E04B 7/18* (2006.01)

(52) U.S. Cl. ..... 52/200; 52/60; 52/72

(58) Field of Classification Search ..... 52/198, 52/199, 200, 218, 219, 300, 301, 72, 60; 49/505; 248/342, 343, 344; 359/591
See application file for complete search history.

(56) References Cited

U.S. PATENT DOCUMENTS 3,765,317 A 10/1973 Lowe
4,843,794 A * 7/1989 Holtgreve ..... 52/199
4,893,608 A * 1/1990 Reaser ..... 126/85 B
4,941,300 A * 7/1990 Lyons, Jr. ..... 52/58
5,596,848 A * 1/1997 Lynch ..... 52/200
6,256,947 B1 7/2001 Grubb

FOREIGN PATENT DOCUMENTS

DE 6603327 10/1967

* cited by examiner

*Primary Examiner*—Robert Canfield
*Assistant Examiner*—Christine T Cajilig
(74) *Attorney, Agent, or Firm*—Turner Padget Graham & Laney, P.A.

(57) ABSTRACT

A swiveling skylight mount and system is provided. The mount may include a base mount defining an opening therein, the opening bounded by a constantly radiused wall. The mount may also include an adjustment ring, the adjustment ring including an aperture adapted for receipt of a skylight tube. The adjustment ring may include a constantly radiused outer surface. The outer surface of the adjusting ring may be disposed at least partially against the wall defined by the opening in the base mount, and adapted to swivel relative to the base mount. Such a swiveling sky mount may also be included in an adjustable skylight system, that also includes a flashing unit to which the base mount may be attached, and a light transmissive dome.

23 Claims, 5 Drawing Sheets

ADJUSTABLE SKYLIGHT ANGLE ADAPTOR AND SYSTEM

FIELD OF THE INVENTION

The presently disclosed technology relates to apparatuses and methodologies concerning skylights for buildings. In particular, the presently disclosed technology relates to an adaptor and system providing an angularly adjustable skylight angle.

BACKGROUND OF THE INVENTION

Skylights provide for the transmission of natural light to the interior of buildings. Popular both in commercial and residential structures, skylights provide a more pleasing and desirable source of interior illumination and reduce the consumption of electricity.

Traditional skylights are constructed with a light shaft between a skylight lens upon a building roof and an opening in an interior ceiling. The light shaft may include conventional framing and sheetrocking between the skylight lens and the interior opening below.

Alternatively, tubular skylights may be used. A tubular skylight may include an exterior dome upon the roof of the building, an interior light diffuser at the interior building ceiling, and a light tube disposed between the dome and diffuser.

Tubular skylights include a number of unique characteristics that may be advantageous in certain applications. For examples, tubular skylights may be purchased as pre-assembled systems, making installation easier and requiring less construction expertise. Tubular skylights also may be used without the need for reinforcing structural supports. Tubular skylights may require less involved constructional logistics that the afore-mentioned light shaft skylights. They may also be used in spaces too small for such traditional skylights.

Additionally, tubular skylights may be installed in less time than is required to install a traditional skylight. Installation of currently-existing tubular skylights may include the following steps. First, the preferred location of the interior diffuser may be located upon the interior building ceiling, then perhaps adjusted so as to avoid interference with existing ceiling joists. Thereafter, from the attic space above the ceiling, a direct path may be established between the ceiling location to the exterior building roof. Such a direct path may be desirable, to avoid elbow joints with the use of rigid skylight tubes or bends with the use of flexible skylight tubes, so as to provide a straight path for incoming sunlight, inasmuch as a straight path results in greater transmission of such sunlight. However, such a direct path may not be available, either because of framing, HVAC ductwork, piping, and/or wiring within the attic space, or because of interfering structures upon the roof. Once final ceiling and roof locations have been identified, holes are cut through each. Thereafter, various configurations of interior ceiling diffuser mounts and rooftop structural mounts may be utilized, as commercially available. Next, a light tube is disposed between the roof and the ceiling. However, unless a direct line could be established between the roof and the ceiling, either a flexible light tube (itself bent) or a rigid light tube with one or more elbow units may need to be used between the two openings to connect the ceiling diffuser to the rooftop mount.

Experience with the currently-existing tubular skylights has identified several challenges. For example, dimensions between the exterior roof and the interior ceilings vary greatly from one building to another. As noted above, for example, placement of the interior diffuser within a building depends not only upon the particular dimensions of the individual building, which may differ significantly from one application to another, but also upon the subjective preferences of the individual installer or building owner. Furthermore, as to such a structure, depending upon placement of the exterior dome upon the roof relative to placement of the diffuser on the interior ceiling, still further dimensional variables are presented. For example, different roofs have different pitches, and different rooftop structures, such as vents, chimneys, and the like, might be found upon any particular building during any particular application that would require placement of the rooftop unit in a different location.

Simply put, the variables to be reckoned with for proper installation of a tubular skylight within a particular building include the location of the interior diffuser, the location of the exterior roof unit relative to the interior diffuser, and the angle between those two components. Economy of manufacture urges that standardization of tubular skylight components would be desirable, yet a single configuration of the currently-known tubular skylights does not account for the virtually infinite variations of such variables encountered in the field. It would be desirable to have a skylight system with a tubular tunnel assembly that could be finely adjusted to meet the variations in angle between the rooftop assembly and the interior assembly.

The apparatus of U.S. Pat. No. 5,596,848 purports to be adapted to suit a variety of roof pitches in a tubular skylight assembly. However, use of that apparatus is limited by its inherent features. While some adjustment of the angular orientation of the described apparatus might be made about lugs, the sides 23 of the apparatus constrain such movement in many directions. Furthermore, the apparatus admits only to articulation about fixed horizontal axis 26. While axis 26 may be changed at installation between various pairs of the grooves formed on the rim of the base, that number of pairs of grooves is finite, and therefore the adjustability of the angular orientation of the depending light tube likewise is finite. The described apparatus also is comparatively complicated to manufacture and, should a lug be broken, the apparatus would be rendered useless.

It has also been found preferable to minimize the use of elbows within the light tube. While the currently known tubular skylight systems may require the use of such elbows to provide for connection between the rooftop unit and the interior diffuser, use of such elbows has been found to reduce the amount of light transmitted through the skylight assembly. Examples of such elbows are shown in U.S. Pat. No. 6,256,947. It would be preferable to avoid the use of any such elbows.

Even with the use of flexible tubing between the rooftop assembly and the interior diffuser, experience has shown that it may be preferable in some applications for such flexible tubing to extend directly, in a straight line, from the rooftop mount to the interior diffuser, rather than to bend or to use rigid elbows so as to adapt for angular displacements between the rooftop mount and the interior diffuser. As noted above, every elbow or bend in the light tube may result in diminishment of the amount of sunlight transmitted by the skylight system.

As suggested above, the buildings in which tubular skylights might be installed often have pitched roofs. While roof pitch usually is at one of only several standard gradients, the angle at which the light tunnel beneath such a roof must traverse, relative to the plane of the roof, to reach the interior diffuser panel may vary infinitely between different applications. Experience in the field teaches that precise measurement, satisfactory alignment, and efficient light transmission can be difficult to achieve with some presently-known tubular skylights. Careful measurement and advance planning, even by a skilled craftsman, must account for satisfactory final installation in three dimensions, which multiplies the opportunity for human error. It would be desirable therefore to have a skylight assembly that would allow for simple yet effective fine tuning in the field of the angular orientation of the light tunnel between the roof mount and the interior diffuser.

It has also come to be recognized that some tradesmen installing tubular skylights prefer to assemble and install as much of the skylight system as possible from the building roof, minimizing the amount of time and assembly required indoors, either inside the building itself or in the attic space between the ceiling and roof. Because those who install tubular skylights view as preferable those devices that can be more completely assembled and installed from the rooftop, it would be desirable to have a skylight system that allows for assembly and installation of as much of the system as possible from the exterior building roof.

Still further, differential thermal expansion between various components of a tubular skylight assembly must be recognized. Variations in the temperatures between a building interior and exterior, as well as variations in ambient outdoor temperature between the yearly seasons, may cause differential thermal expansion between the components of some presently-known tubular skylight systems that impairs the integrity of the skylight system. It would therefore be desirable to have a tubular skylight system that addresses differential thermal expansion concerns and thereby preserves the integrity of the tubular skylight system.

Furthermore, it has been found in some installations that humidity intrudes to the interior of a tubular skylight system, and may condense at the exterior skylight dome. It would be preferable, therefore, to have a tubular skylight system that allows for drainage of condensed moisture from the skylight dome to the exterior of the building roof.

It would thus be desirable to have a tubular skylight system meeting one or more of the foregoing concerns that is also durable, reliable, and easily and inexpensively manufactured.

While various tubular skylights have been developed, no design has emerged that generally encompasses all of the desired characteristics as hereafter presented in accordance with the subject technology.

SUMMARY OF THE INVENTION

In view of the recognized features addressed by the present subject matter, an adjustable skylight angle adaptor and system is disclosed.

In accordance with certain aspects of certain embodiments of the present subject matter, a swiveling skylight mount is provided that may include an adjustment ring. The adjustment ring may define an aperture therethrough, the aperture adapted for receipt of a skylight tube. The adjustment ring may include an outer surface opposite the aperture, the outer surface being at least partially continuously radiused. The swiveling skylight mount may also include a base mount, the base mount including a wall therein defining an opening therethrough. The wall may be continuously radiused, and configured to engage with the outer surface of the adjustment ring. The opening through the base mount may be larger than the aperture defined through the adjustment ring.

In accordance with additional aspects of other embodiments of the present technology, the outer surface of the adjustment ring may have a frustospherical shape. Alternatively, the wall defining an opening through the base mount may have a frustospherical shape. Alternatively still, both the outer surface of the adjustment ring and the wall defining the opening through the base mount may both have a frustospherical shape.

In accordance with yet additional aspects of other embodiments of the present technology, the base mount may be configured for water-resistant engagement to a skylight flashing unit.

In accordance with still further aspects of other embodiments of the present technology, the base mount may be configured for receipt of a skylight dome. In accordance with yet still further aspects of other embodiments of the present technology, the base mount may further include a means for draining. Alternatively, or additionally, the base mount may include at least one drain.

In accordance with aspects of other embodiments of the present subject matter, a swiveling skylight mount may be provided that includes a base mount, the base mount having a top side and an opposed bottom side. The base mount may define an opening from the top side to the bottom side, the opening larger at the top side relative to the opening at the bottom side. The opening may be bounded between the top and bottom sides by a generally frustospherical wall having a predetermined radius. The swiveling skylight mount may also include an adjustment ring, the adjustment ring defining an aperture therethrough. The aperture may be adapted for receipt of a skylight tube. The adjustment ring may also include an outer surface opposite the aperture, the outer surface being shaped at least partially generally frustospherically with about the predetermined radius of the opening from the top side to the bottom side of the base mount. The swiveling skylight mount may include the adjustment ring disposed within the opening of the base mount, with the adjustment ring outer surface generally concentric with the base mount opening wall, the adjustment ring outer surface disposed at least partially against the base mount opening wall, whereby the adjustment ring is adapted to swivel relative to the base mount.

In accordance with additional aspects of other embodiments of the present technology, the base mount may be annular. Alternatively, or additionally, the adjustment ring may be annular.

In accordance with yet additional aspects of other embodiments of the present technology, the base mount may include a means for water-resistance engagement to a skylight flashing unit.

In accordance with aspects of other embodiments of the present technology, an adjustable skylight system is provided that may include a flashing unit and a base mount. The base mount may be carried by the flashing unit. The base mount may define an opening therethrough, the opening at least partially continuously radiused. An adjustment ring may also be included, the adjustment ring defining an aperture therethrough. The aperture through the adjustment ring may be adapted for receipt of a skylight tube. The adjustment ring may include an outer surface opposite the aperture, the outer surface having a shape at least particularly complementary of the base mount opening. The adjustment ring may be adapted to slidably swivel within the opening of the base mount with the adjustment ring outer surface at least partially against the base mount opening wall. This system may also include a cover, the cover being light transmissive. The cover may be disposed above the adjustment ring.

In accordance with additional aspects of other embodiments of the present technology, the outer surface of the adjustment ring may include a frustospherical shape. Alternatively, or additionally, the base mount opening may include a frustospherical shape.

In accordance with still further aspects of other embodiments of the present technology, the flashing unit may define a top opening and an opposed bottom opening, the top opening of the flashing unit being bounded by an annular wall, and the base mount including a slot, this slot configured for receipt of the annular wall of the flashing unit.

In accordance with still further aspects of other embodiments of the present technology, the cover may be configured for attachment to the base mount.

In accordance with aspects of other embodiments of the present technology, the cover may be configured for overlapping interconnection with the base mount, and the base mount may define at least one drain. In certain embodiments, the drain may include a top end and an opposed bottom end, the top end larger than the bottom end.

In accordance with yet additional aspects of other embodiments of the present technology, an adjustable skylight system is provided that may include a means for securing a skylight tube within the aperture of the adjustment ring.

In accordance with yet still further aspects of other embodiments of the present technology, the flashing unit may include at least one diverter.

In accordance with yet still further aspects of other embodiments of the present technology, the flashing unit may include a riser and the flashing unit may be adapted for attachment to a building roof having a pitch of between 3 and 12 and 7 and 12.

In accordance with aspects of other embodiments of the present subject matter, an adjustable skylight system is provided that includes a flashing unit, a base mount, an adjustment ring, and a dome. The flashing unit may define a top opening and an opposed bottom opening, with walls disposed between the top and bottom openings. The base mount may be annular, and the base mount may be carried by the flashing unit. The base mount may define a seat, the seat having a configuration of a portion of the sphere, the base mount further defining a first opening extending through a central portion of the seat. The adjustment ring may include an at least partially frustospherical outer surface, the frustospherical outer surface having a center of curvature coincident with the center of curvature of the seat. The adjustment ring may define a second opening extending through the adjustment ring, adapted for receipt of a skylight tube, the second opening smaller than the first opening extending through the base mount. The outer surface of the adjustment ring may be carried at least partially within the seat defined by the base mount, the adjustment ring configured for articulation within the seat. The base mount may be configured for receipt of the top opening of the flashing unit. The dome may be light transmissive and configured for interconnection with the base mount.

In accordance with additional aspects of other embodiments of the present technology, the top opening of the flashing unit of the adjustment skylight system may be bounded by an annular wall, and the base mount may include a slot configured for receipt of that annual wall.

In accordance with yet additional aspects of other embodiments of the present technology, this system may include a gasket between the dome and the base mount. Alternatively, or additionally, the base mount may define at least one drain that includes a top end and an opposed bottom end, the top end larger than the bottom end.

In accordance with still further aspects of other embodiments of the present technology, the dome may be configured for overlapping interconnection with the base mount, and the base mount may include a means for draining to the exterior of the dome.

In accordance with yet still further aspects of other embodiments of the present technology, the system may include a means for securing a skylight tube within the opening defined by the adjustment ring.

In accordance with other aspects of other embodiments of the present subject matter, an adjustable skylight system is provided that includes a means for mounting the system upon a roof, a base mount, an adjustment ring, a means for swiveling the adjustment ring relative to the base mount, and a dome. The adjustment ring may define an opening extending through the adjustment ring, adapted for receipt of a skylight tube. The dome may be light transmissive and disposed above the base mount.

In accordance with yet additional aspects of other embodiments of the present technology, the adjustable skylight system may include a means for connecting the base mount to the a means for mounting the system upon a roof.

In accordance with still further aspects of other embodiments of the present technology, the adjustment skylight system may include a means for attaching the dome to the base mount.

In accordance with yet still further aspects of other embodiments of the present technology, the system may include a means for draining water from inside the dome to outside the base mount.

Additional aspects and features of the present subject matter are set forth in the appended drawings and in the detailed description below, or will be apparent to those of ordinary skill in this technology. It should be further appreciated that modifications and variations to specific features and elements may be practiced in various embodiments, and uses of the inventions, without departing from the spirit and scope of the subject matter. Variations might include, but are not limited to, substitution of equivalent means, features, or aspects for those that are illustrated, referenced, or discussed herein, as well as the functional, operational, or positional reverse of various parts, features, aspects, or the like.

It is to be understood that different embodiments, as well as different presently preferred embodiments of the present subject matter, may include various combinations or configurations of the presently disclosed features, elements, or aspects, or their equivalents. Such embodiments may include combinations of features, parts, or aspects, or configurations thereof, that are not expressly shown in the figures or stated in the detailed description.

Additional embodiments of the present subject matter, not necessarily expressed in the summarized section, may include or incorporate various combinations of aspects of features, components, or aspects referenced in the summarized subjects above, and/or other features, components, or aspects as otherwise discussed in this disclosure. Those of ordinary skill in the art will better appreciate the features and aspects of such embodiments and others upon review of the remainder of this specification.

BRIEF DESCRIPTION OF THE DRAWINGS

A full and enabling disclosure of the present invention, including the best mode thereof, directed toward one of ordinary skill in the art, is set forth in the specification, which makes reference to the appended figures. It should be noted that the appended drawings are not necessarily to scale in all instances, but may have altered dimensions in some respects to illustrate the principles of the technologies.

DETAILED DESCRIPTION

Figure 1:
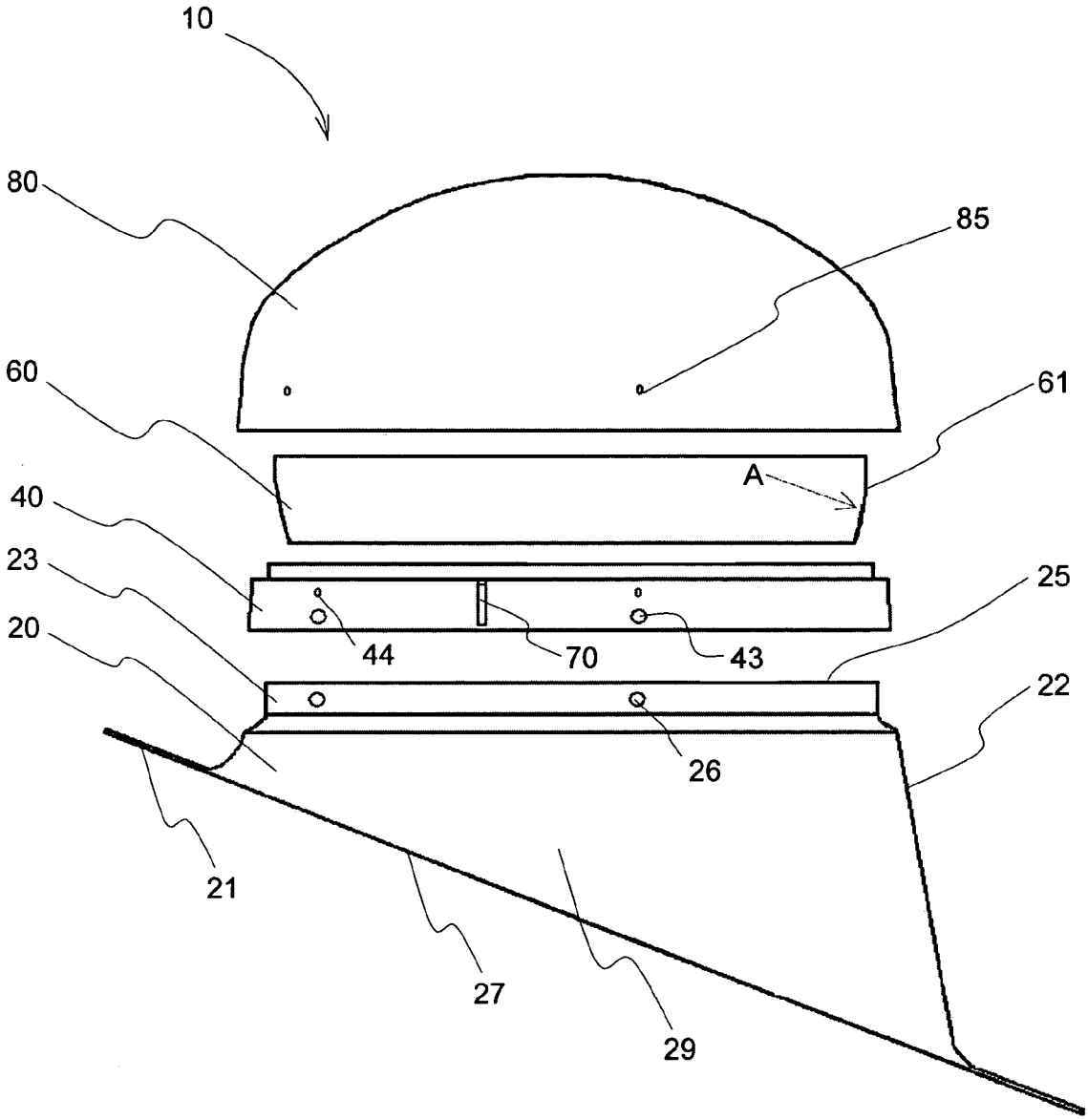
FIG. 1 is an exploded side view of an adjustable skylight angle adapter and system in accordance with certain aspects of the present invention.

Reference will now be made in detail to presently preferred embodiments of the subject technology, one or more examples of which are illustrated in the drawings. Each example is provided by way of explanation of the invention, and is not meant as a limitation of the invention. Features illustrated or described as part of one embodiment may be used on another embodiment to yield a further embodiment. It is intended that the present application includes such modifications and variations as come within the scope and spirit of the invention. Selected combinations or aspects of the disclosed technology correspond to a plurality of different embodiments of the present invention. Certain features may be interchanged with similar devices or features not expressly mentioned, which perform the same or similar function.

Various tubular skylights may be practiced in combination with the subject invention. An example of such a tubular skylight is disclosed in application Ser. No. 10/754,975, entitled "Skylight With Displacement Absorber And Interlocking Telescoping Lens," owned by the same Assignee as the present invention and incorporated herein fully by reference.

Figure 4:
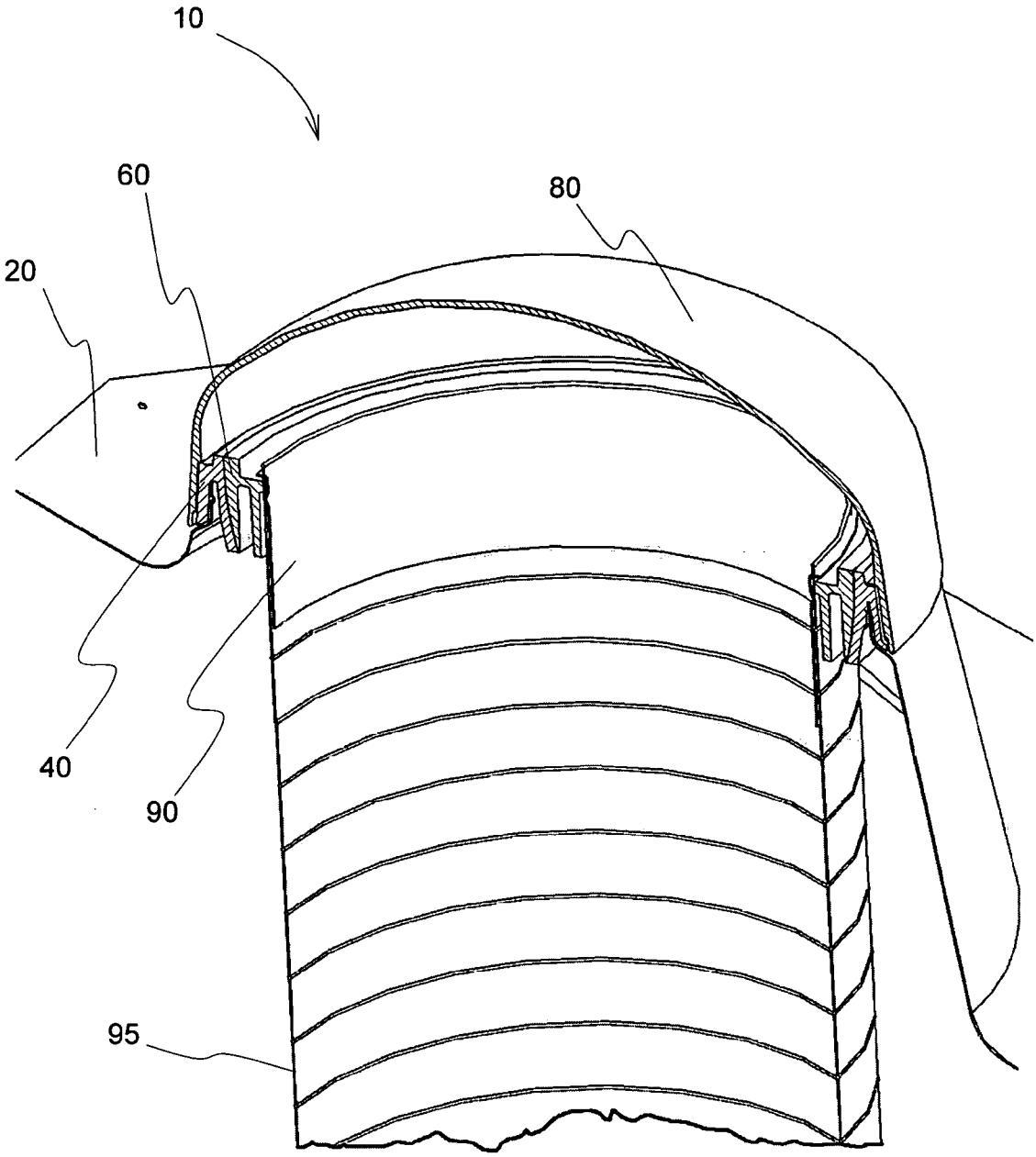
FIG. 4 is a cross-sectional perspective view, taken along line E-E in FIG. 2 of an adjustable skylight angle adaptor and system in accordance with certain aspects of the present invention.

According to the present invention, an adjustable skylight angular adaptor and system is provided. As shown in FIGS. 1 and 4, the system may include dome 80, adjustment ring 60, base mount 40, flashing unit 20, and light tube 95.

The present system includes a means for mounting the system upon a building roof. Corresponding structures to perform the function of mounting the system upon a building roof are, in part, disclosed in FIGS. 1, 2, 4, and 6. A flashing unit 20 may be provided. Flashing unit 20 defines a top opening 25 and an opposed bottom opening 27. Walls 29 are disposed between top opening 25 and bottom opening 27. Top opening 25 may be bounded by mounting flange 23. Mounting flange 23 may be annular, although such a shape is not necessary to the practice of the subject technology and other geometric shapes may be used. As will be described in more detail, mounting flange 23 may include a plurality of mounting holes 26, for receipt of a knurled pin 42 (FIG. 5) or other suitable structure upon assembly of the system. Also as will be further described below, flashing unit 20 may carry a gasket 24, for weather proofing against base mount 40.

Figure 6:
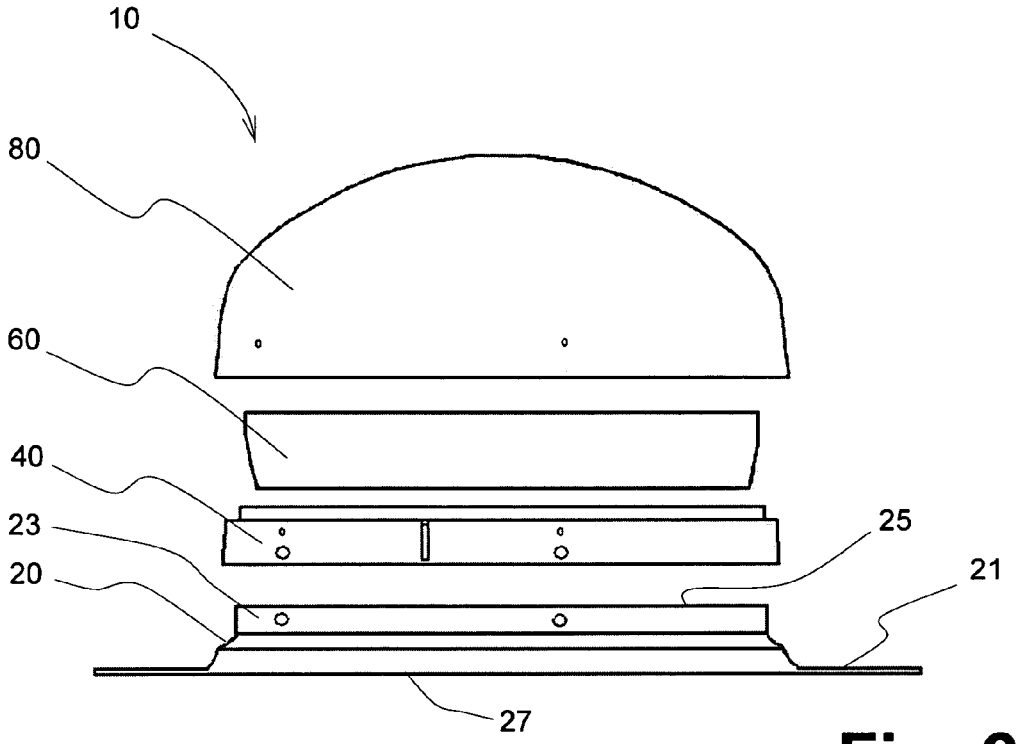
FIG. 6 is an exploded side view of another embodiment of an adjustable skylight angle adaptor and system in accordance with certain aspects of the present invention.

Comparison between FIG. 1 and FIG. 6 illustrates that flashing unit 20 may be constructed in a variety of configurations. For example, FIG. 1 illustrates a flashing unit 20 for use upon a pitched roof, flashing unit 20 in such an embodiment including flashing riser 22 on the down-roof side of flashing unit 20. Flashing riser 22 may be of any desired height. With use of flashing riser 22 on the down-roof side, the embodiment of flashing unit 20 shown in FIG. 1 may be used upon a pitched roof to establish an approximately horizontal orientation of mounting flange 23. By comparison, and with reference to FIG. 6, the absence of a flashing riser 22 provides for flashing unit 20 to be configured upon a flat roof, with mounting flange 23 disposed in a plane parallel to such a roof.

Flashing unit 20 may also include skirt 21 disposed about its perimeter. Flashing skirt 21 is adapted for co-planar mounting upon a planar roof.

Figure 2:
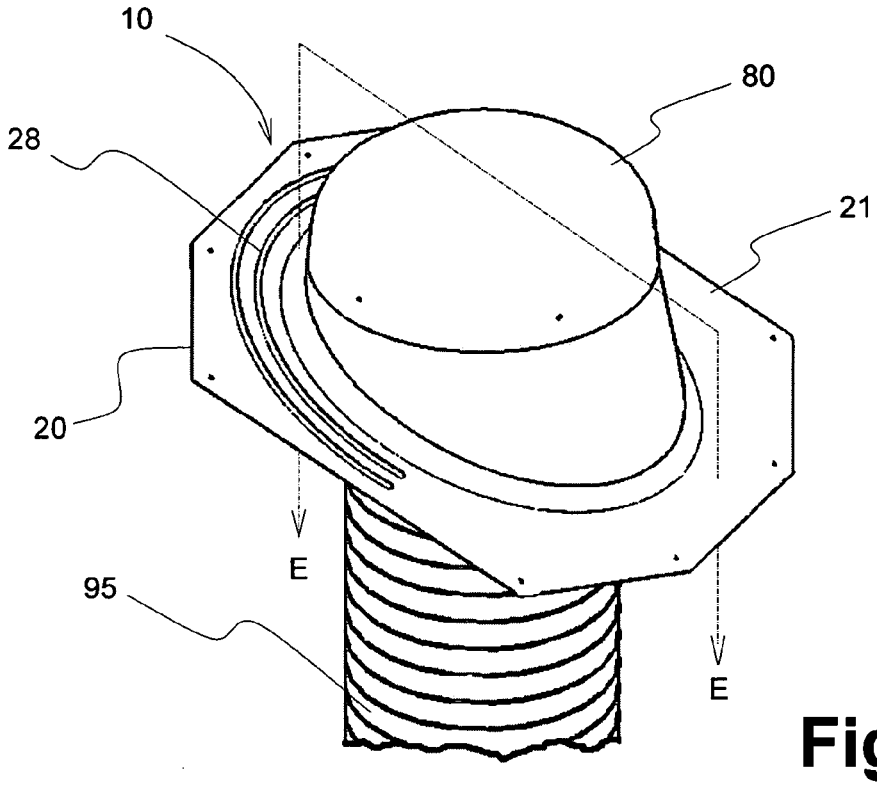
FIG. 2 is a perspective view of a flashing unit, dome, and light tube of a skylight system in accordance with certain aspects of the present invention.

FIG. 2 illustrates that flashing unit 20 also optionally may be provided with one or more diverters 28. Diverters 28 may be disposed on the up-roof side of flashing unit 20 on a pitched roof configuration. So disposed, diverters 28 may divert rainwater that is flowing downward upon the roof toward flashing unit 20 from a roof upon which flashing unit 20 is mounted. Additionally, diverters 28 may be utilized to add rigidity to flashing skirt 21.

Figure 5:
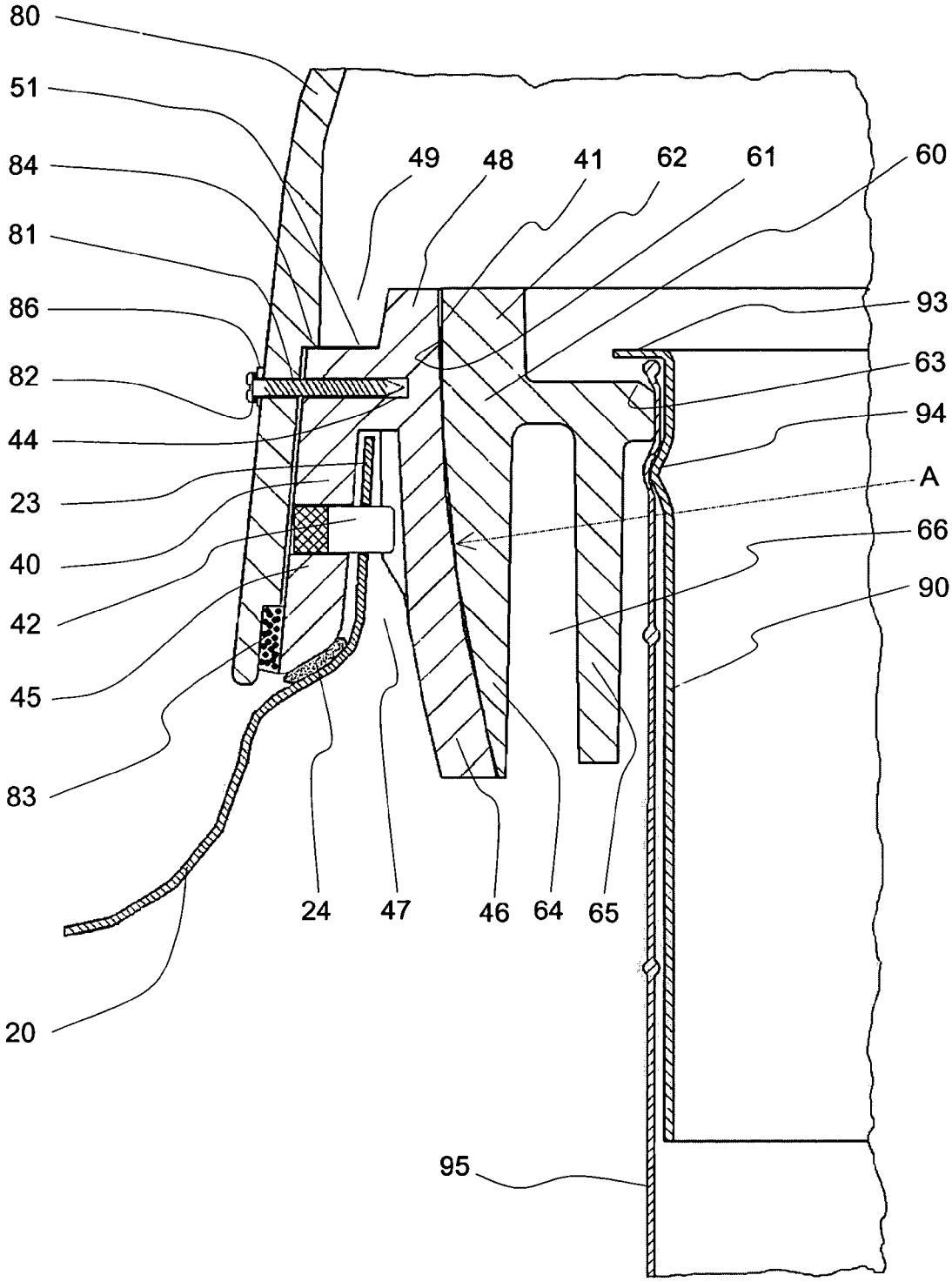
FIG. 5 is a close-up partial cross-sectional view taken along line E-E in FIG. 2; of an adjustable skylight angle adaptor and system in accordance with certain aspects of the present invention.

Aspects and embodiments of base mount 40 are shown in FIGS. 1, 3, 4, 5, 6, and 7. Base mount 40 may include a means for water-resistant engagement to flashing unit 20. Corresponding structures that perform the function of water-resistance engagement to flashing unit 20 are, in part, shown in FIGS. 4 and 5. Mounting ring 40 may be configured to include first leg 45 and second leg 46, with flashing slot 47 disposed therebetween. Mounting flange 23 may be received within slot 47 and secured by knurled pin 42, knurled pin 42 having been disposed through pinhole 43 (shown in FIG. 1). As depicted in FIG. 5, flashing gasket 24 may be carried upon flashing unit 20, disposed between flashing unit 20 and first leg 45 to provide a weatherproofing seal or to aid in the prevention of insect infiltration interior to system 10. Flashing gasket 24 may be a closed cell polyurethane gasket.

Knurled pin 42 may be of stainless steel. However, screws, rivets, snap fit engagement, and threaded engagement between base mount 40 and mounting flange 23 may be used to engage, attach, or otherwise affix base mount 40 on flashing unit 20.

As shown in the figures, base mount 40 is illustrated to be annular. However, such annular shape is not necessary for the practice of this technology, and other suitable shapes may be utilized.

Base mount 40 includes a means for swiveling adjustment ring 60 relative to base mount 40. Corresponding structures that perform the function of swiveling adjustment ring 60 relative to base mount 40 are, in part, disclosed in FIGS. 3, 4, and 5, and also will be discussed in additional detail below with reference to adjustment ring 60. Base mount 40 includes wall 41 therein defining an opening through base mount 40. Wall 41 may be continuously radiused. In certain embodiments, wall 41 may be completely nonplanar, such that no three points may be located upon wall 41 lying within a single plane. As will be described in more detail below, wall 41 may be configured to engage with the outer surface 61 of adjustment ring 60.

In some embodiments, wall 41 may be frustospherical in shape.

Figure 3:
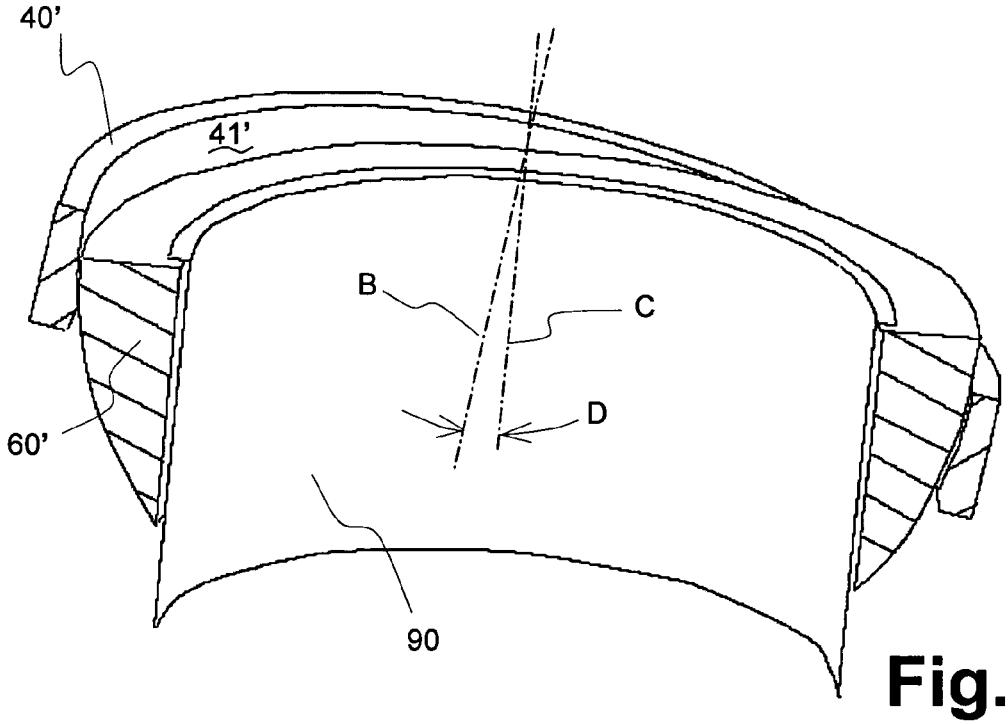
FIG. 3 is an simplified, illustrative, cross-sectional sketch, taken along line E-E in FIG. 2, of an adjustment ring swiveled within a base mount.

FIG. 3 is a simplified, illustrative, cross-sectional sketch that includes, in part, a simplified representation base mount 40'. Base mount 40', as base mount 40, may have a top side and an opposed bottom side with an opening defined between the top and bottom sides. As illustrated for example in FIG. 3, the opening defined in base mount 40' may be larger at the top relative to the bottom, with the continuously radiused or frustospherically shaped wall 41 therebetween.

In other embodiments, it may be understood that base mount 40 may define a seat, the seat having a configuration of a portion of the sphere bounded by walls 41 within base mount 40. So configured, base mount 40 may further define an opening extending through a central portion of the seat for receipt of adjustment ring 60, as illustrated for example in FIG. 3.

Base mount 40 also may be configured for receipt of dome 80. As illustrated for example in FIG. 5, dome 80 may be configured for overlapping interconnection with base mount 40. So configured, a dome gasket 83 may be disposed between base mount 40, for example adjacent to first leg 45, and dome 80.

Figure 7:
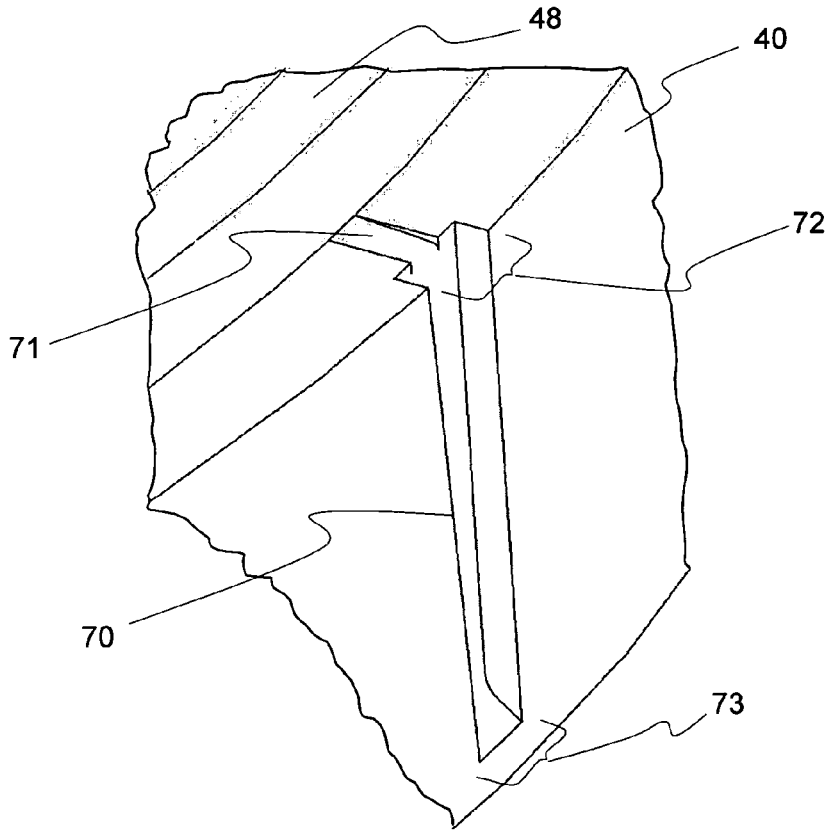
FIG. 7 is a close-up, perspective view of a base mount drain in accordance with certain aspects of the present invention.

Base mount 40 also may include a means for draining moisture from the interior system 10 to its exterior. Corresponding structures that perform the function of draining are, in part, disclosed in FIGS. 1, 6, and 7. Base mount 40 may be configured with a rim 48 (FIGS. 5 and 7) and, outboard of such rim 48, a gutter floor 51. Moisture condensing upon the interior surface of dome 80 and traveling along that surface may reach gutter floor 51 and, because of rim 48, be prevented from passing further toward the interior of system 10. Base mount 40 may include at least one drain 70 about the exterior perimeter of base mount 40. With particular reference to FIG. 7, drain 70 may be understood to include a groove 71 along gutter floor 51 of base mount 40. Groove 71 is disposed to interconnect with upper opening 72 of drain 70. Moisture within groove 71, therefore, would drain to an upper opening 72 of drain 70, and be gravitationally driven toward lower opening 73 of drain 70. Upper opening 72 may be configured to be larger than lower opening 73. So configured, drain 70 would tend to provide an increased head upon any water accumulated within drain 70. Such increased head would provide increased resistance against water within drain 70 being driven by wind up drain 70 and back to the interior of system 10. Plural drains 70 may be located about base mount 40; for advantageous reasons in some applications, drains 70 might not be located at the upper-roof location of base mount 40, to avoid the possibility of water, flowing down the roof toward system 10, being driven backwards up a drain 70 at such a location. Additionally, dome gasket 83 will be understood to be disposed proximate to lower opening 73 of drain 70. Dome gasket 83 may be of open cell foam, and thereby tend to wick water from drain 70 to the exterior of system 10. Furthermore, dome gasket 83 would further inhibit water from being forced by wind backwards up through drain 70 to the interior of system 10. Additionally, dome gasket 83 may provide a further barrier against insect infiltration to the interior of system 10.

System 10 also includes adjustment ring 60, embodiments of which are illustrated in FIGS. 1, 3, 4, 5, and 6.

System 10 includes a means for swiveling adjustment ring 60 relative to base mount 40. Corresponding structures that perform the function of swiveling adjustment ring 60 relative to base mount 40 are, in part, disclosed in FIGS. 1, 3, 4, 5, and 6. Adjustment ring 60 includes outer surface 61. Outer surface 61 in some embodiments may be continuously radiused. In certain of those embodiments, outer surface 61 may be constantly radiused of a radius A illustrated in FIG. 5.

In certain other embodiments of the present invention, outer surface 61 of adjustment ring 60 may be shaped at least partially generally frustospherically about a predetermined radius A. In certain of those adaptations, system 10 may also include base mount 40 within inner wall 41 likewise shaped generally frustospherically about predetermined radius A.

With reference to FIG. 5, it will be understood that adjustment ring 60 may have an outer surface 61 that is frustospherical having a center of curvature coincident with a frustospherically shaped wall 41 of base mount 40. In other embodiments, adjustment ring 60 may include an outer surface 61 having a shape at least partially complementary of wall 41 of base mount 40, adjustment ring 60.

In such configurations and embodiments, outer surface 61 of adjustment ring 60 may be carried at least partially within the opening defined within base mount 40, bounded by walls 41, adjustment ring 61 thereby configured for articulation within base mount 40.

Adjustment ring 60 defines an aperture therethrough, the aperture adapted for receipt of a light tube 95. As shown, for example, in FIG. 5, adjustment ring 60 may be configured with an upper member 62, a first profile 64, and a second profile 65. Profiles 64, 65 may define between them a cavity 66 for weight-saving purposes. So configured, adjustment ring 60 is adapted to carry light tube 95. Light tube 95 may be a flexible tube such as is illustrated in FIG. 2. Alternatively, light tube 95 may be a rigid tube (not shown) or a telescoping tube (not shown).

System 10 may include a means for securing skylight tube 95 within the aperture defined through adjustment ring 60. Corresponding structures that perform the function of securing skylight tube 95 within the aperture defined through adjustment ring 60 are, in part, disclosed in FIGS. 3, 4, and 5. Light tube 95 may be positioned and held within adjustment ring 60 with a collar 90. Collar 90 may be disposed interior of a light tube 95 positioned within adjustment ring 60. Collar 90 may include a shoulder 93 and a dimple 94, shoulder 93 and dimple 94 configured to interfit about a shoulder 63 of adjustment ring 60. Because of the interpositioning of shoulder 93 of collar 90, the upper end of light tube 95 would be prevented from further upward movement relative to adjustment ring 60; because of the interpositioning of dimple 94 relative to light tube 95, light tube 95 would be inhibited from downward movement relative to adjustment ring 60. Indeed, collar 90 may be used to compress the upper end of light tube 95 against shoulder 63, and thereby secure light tube 95 within adjustment ring 60.

Dome 80 provides a cover to system 10, and transmits light to the interior of system 10 for conveyance to the interior of a building in which system 10 is installed. System 10 may include a means for attaching dome 80 to base mount 40. Corresponding structures that perform the function of attaching dome 80 to base mount 40 are, in part, disclosed in FIGS. 4 and 5. Dome 80 may be configured for overlapping interconnection with base mount 40. As shown in FIG. 5, dome 80 may overlap first leg 45 of base mount 40. The interpositioning of dome 80 relative to base mount 40 may be predetermined by use of an impact notch 84. Impact notch 84 may be of predetermined dimension, to interfit against gutter floor 51 of base mount 40 as dome 80 is properly positioned. So positioned, dome 80 may be secured to base mount 40 with use of dome screws 81, but other fasteners may be used. Base mount 40 may be premanufactured to include screw holes 44 corresponding to screw holes 85 (FIG. 1) defined within dome 80.

Dome 80 also may include screw bosses 86. Considering that the outer surface of dome 80 may be of curvilinear cross-section in some embodiments, screw bosses 86 may be included to allow for installation of screws 81 perpendicular to the center axis of base mount 40.

Additionally, for further weatherproofing, O-rings 82 may be used between the head of screw 81 and dome 80 or screw boss 86, as the case may be.

Accordingly, system 10 may provide for an adjustable skylight angle adaptor and system that provides a high degree of adjustability of the angular orientation of a depending light tube from a rooftop mount. With reference to FIG. 3, it will be appreciated that, in the simplified illustration, adjustment ring 60' may have a center axis C. Base mount 40' may have a center axis B. By disposing adjusting ring 60' within the aperture of base mount 40', adjustment ring 60' may be angularly oriented about an infinite number of angles D between center axes B and C. Furthermore, it will be appreciated that adjustment ring 60' may be rotated about its own center axis C within base mount 40', for any advantageous reason in particular applications.

Installation of system 10 at a particular building may proceed along the following steps. First, a preferred location for an interior ceiling diffuser may be selected. Relative to such location, a corresponding desired location upon the roof of the building for a roof mount may be located. Owing to the adjustability of system 10, the relative locations of the interior ceiling opening and the exterior roof opening need not be vertical, and in some applications need not even be precisely measured. Thereafter, a flashing unit 20 may be installed over the roof opening. Of course, flashing unit 20 may be installed by a tradesman exterior to the building, upon the roof. A base mount 40 may thereafter be installed upon the flashing unit 20, by insertion of mounting flange 23 of flashing unit 20 within slot 47 of base mount 40. Base mount 40 may thereafter be affixed to mounting flange 23 by use of knurled pins 42. At that point, and still from the exterior of the building, a light tube 95 may be positioned within the aperture of an adjusting ring 60. Light tube 95, once disposed in a preferred configuration within adjusting ring 60, may be affixed to such position by use of a collar 90. Next, the configured assembly, including light tube 95, collar 90, an adjusting ring 60, may be inserted through the aperture defined within base mount 40 and bounded by walls 41. It will be appreciated that, so configured, the cross section of light tube 95 will be smaller than the dimension defined by second leg 46 if base mount 40. The adjusting ring 60/light tube 95/collar 90 assembly may simply be inserted through base mount 40 until outer wall 61 of adjusting ring 60 abuts against wall 41 of base mount 40. At that point in time, dome 80 may be installed over base mount 40. Proper positioning of dome 80 upon base mount 40 may be determine when impact notch 84 abuts against gutter floor 51 of base mount 40. Dome gasket 83, carried by dome 80, would seal against base mount 40, and dome 80 could be affixed to base mount 40 using screws 81. At that point, the exterior mounting of system 10 would be complete, and the lower end of light tube 95 could then be affixed to a suitable interior diffuser within the building. Any angular displacement between the locations of the interior diffuser and the exterior roof mount would be accommodated by a rotation or angular swiveling of adjusting ring 60 within base mount 40.

While the particular adjustable skylight angle adaptor and system as herein shown and described in detail encompasses all of the desired characteristics as here and above described, it is to be understood that it is the presently preferred embodiment of the present invention and is thus representative of other subject matter that is broadly contemplated by the present invention. It is to be further understood that the scope of the present invention fully encompasses other embodiments that may become obvious to those skilled in the art. It is intended that the present invention includes such modifications and variations as come within the scope of the appended claims and there equivalents, in which reference to an element in the singular is not intended to mean "one and only one" unless explicitly so stated, but rather "one or more."

What is claimed is:

1. An adjustable skylight system, comprising:

a flashing unit;

a base mount, said base mount carried by said flashing unit, said base mount defining an opening therethrough, said opening being at least partially continuously radiused;

an adjustment ring, said adjustment ring defining an aperture therethrough, said aperture adapted for receipt of a skylight tube, said adjustment ring including an outer surface opposite said aperture, said outer surface having a shape at least partially complementary of said base mount opening, said adjustment ring adapted to slidably swivel within said opening of said base mount with said adjustment ring outer surface at least partially against said base mount opening;

said adjustment ring carried only by said base mount within said adjustable skylight system;

a cover, said cover being light transmissive, said cover disposed above said adjustment ring.

2. The adjustable skylight system of claim 1, wherein said outer surface includes a frustospherical shape.

3. The adjustable skylight system of claim 1, wherein said base mount opening includes a frustospherical shape.

4. The adjustable skylight system of claim 2, wherein said base mount opening has a frustospherical shape.

5. The adjustable skylight system of claim 1, wherein said base mount is configured for water-resistant attachment to said flashing unit.

6. The adjustable skylight system of claim 1, wherein:

said flashing unit defines a top opening and an opposed bottom opening, said top opening of said flashing unit being bounded by an annular wall; and said base mount includes a slot, said slot configured for receipt of said annular wall of said flashing unit.

7. The adjustable skylight system of claim 5, said cover configured for attachment to said base mount.

8. The adjustable skylight system of claim 7, said base mount further including at least one drain.

9. The adjustable skylight system of claim 1, wherein:

said cover is configured for overlapping interconnection with said base mount;

said base mount defines at least one drain.

10. The adjustable skylight system of claim 9, wherein said at least one drain includes a top end and an opposed bottom end, said top end larger than said bottom end.

11. The adjustable skylight system of claim 7, said base mount further including means for draining.

12. The adjustable skylight system of claim 1, further including means for securing a skylight tube within said aperture.

13. The adjustable skylight system of claim 1, said flashing unit further including at least one diverter.

14. The adjustable skylight system of claim 1, wherein said flashing unit includes a riser and is adapted for attachment to a building roof having a pitch of between 3 in 12 and 7 in 12.

15. An adjustable skylight system, comprising:

a flashing unit, said flashing unit defining a top opening and an opposed bottom opening, said flashing unit including walls disposed between said top and bottom openings;

a base mount, said base mount being annular, said base mount carried by said flashing unit, said base mount defining a seat, said seat having the configuration of a portion of a sphere, said seat defining a center of curvature, said base mount further defining a first opening extending through a central portion of said seat;

an adjustment ring, said adjustment ring including an at least partially frustospherical outer surface, said frustospherical outer surface having a center of curvature coincident with the center of curvature of said seat, said adjustment ring defining a second opening extending through said adjustment ring adapted for receipt of a skylight tube, said second opening smaller than said first opening extending through said base mount;

said outer surface of said adjustment ring carried at least partially within said seat, said adjustment ring configured for articulation within said seat;

said base mount configured for receipt of said top opening of said flashing unit;

said adjustment ring carried only by said base mount within said adjustable skylight system;

a dome, said dome being light transmissive, said dome configured for interconnection with said base mount.

16. The adjustable skylight system of claim 15, wherein:

said top opening of said flashing unit is bounded by an annular wall; and said base mount including a slot, said slot configured for receipt of said annular wall of said flashing unit.

17. The adjustable skylight system of claim 15 wherein:

said dome is configured for overlapping interconnection with said base mount;

said base mount defines at least one drain.

18. The adjustable skylight system of claim 17, further including a gasket between said dome and said base mount.

19. The adjustable skylight system of claim 17, wherein said at least one drain includes a top end and an opposed bottom end, said top end larger than said bottom end.

20. The adjustable skylight system of claim 15, wherein:

said dome is configured for overlapping interconnection with said base mount; and said base mount includes means for draining to the exterior of said dome.

21. The adjustable skylight system of claim 15, further including means for securing a skylight tube within said second opening.

22. The adjustable skylight system of claim 15, said flashing unit further including at least one diverter.

23. The adjustable skylight system of claim 15, wherein said flashing unit includes a riser and is adapted for attachment to a building roof having a pitch of between 3 in 12 and 7 in 12.

* * * * *